US005328172A

United States Patent [19]

Jagiella

[11] Patent Number: 5,328,172

[45] Date of Patent: Jul. 12, 1994

[54] COMBINATION GAME OF CHANCE SELECTION DEVICE AND WRITING PEN

[76] Inventor: Manfred Jagiella, 4026 Devonshire Dr., Marietta, Ga. 30066

[21] Appl. No.: 64,976

[22] Filed: May 20, 1993

[51] Int. Cl.[5] ..... A63F 7/04; A63F 9/04; B43K 29/00

[52] U.S. Cl. ..... 273/144 B; 401/195

[58] Field of Search ..... 273/144 B, 145 C, 145 CA; 401/195

[56] References Cited

U.S. PATENT DOCUMENTS

| | | | |
|---|---|---|---|
| 2,665,915 | 1/1954 | Steig | 273/144 B |
| 2,985,453 | 5/1961 | Matisz | 273/145 C |
| 4,530,503 | 7/1985 | Rice | 273/144 B |
| 4,874,178 | 10/1989 | Gage | 273/144 B X |

FOREIGN PATENT DOCUMENTS

| | | | |
|---|---|---|---|
| 3603302 | 8/1987 | Fed. Rep. of Germany | 273/144 B |
| 483174 | 4/1938 | United Kingdom | 273/145 C |
| 2213070 | 8/1989 | United Kingdom | 273/144 B |

*Primary Examiner*—Paul E. Shapiro
*Attorney, Agent, or Firm*—James A. Hinkle

[57] ABSTRACT

A container has a receiver tube in communication with an internal periphery of the container. The container is sized and shaped to contain a desired plurality of solid objects of equal dimension and density. Each solid object has at least one number or symbol placed visibly on its surface. The receiver tube is sized and shaped to receive a desired number of the solid objects from the container linearly within the receiver tube. Selection of numbers by chance is accomplished by: (1) shaking the container with the receiver tube in a relatively upright attitude to mix the solid objects randomly in the container while preventing entry of the solid objects into the receiver tube, (2) positioning the container with the receiver tube in a relatively downward angle from the container such that a certain number of the solid objects, predetermined by vacant length of the receiver tube, fall one-by-one into the receiver tube where they are contained linearly, and (3) reading the numbers or symbols on the solid objects through a transparent wall of the receiver tube. A writing instrument, such as a pen, can be positioned on a distal end opposite a proximal end of the receiver tube to which the container is attached to form a writing instrument with which chance selections can be recorded conveniently when read. Different shapes of solid objects, variable lengths of receiver tubes and other options are provided for different preferences and applications.

3 Claims, 1 Drawing Sheet

COMBINATION GAME OF CHANCE SELECTION DEVICE AND WRITING PEN

BACKGROUND OF THE INVENTION

I. Field of the Invention

The present invention relates generally to the field of selectors of numbers and symbols by random chance, particularly for games of chance such as lottery and for decision-making on a chance basis.

II. Description of the Prior Art

There have been a wide variety of games of chance. Dice are a particularly well-known game of chance that are used also for decision-making on a chance basis. Cards are another. Roulette wheels are still another. Recently, however, the use of a lottery system for obtaining income by state and local governments has become popular. Owing to very high returns to very few winners of state-government lotteries, some professional mathematicians and others familiar with probability of random occurrence of number combinations have been motivated to, compete with, and have been able to beat, the public in selection of winning combinations of numbers. This invention, however, provides a better mechanism and method than any other known system for selecting winning lottery numbers. It gives those who use it a better opportunity to win than with expensive and time-consuming professional selection methods. Further, it is inexpensive to produce and can be used simply and conveniently by the general public. Lottery can become again an equal-opportunity activity.

SUMMARY OF THE INVENTION

In accordance with the present invention, it is contemplated that in light of the problems that have existed and that continue to exist for the general public in selecting lottery numbers with high probability of winning and in light of other problems in chance selections and games of chance, objectives of this invention are to provide a lottery number selector which:

Provides selection of combinations of numbers having highest-possible probability of winning lotteries;

Is inexpensive to produce and, therefore, is easily obtained by the general public;

Is convenient to use;

Provides a writing instrument in working relationship with a selection means that can be hand-held while being used; and Can be produced in a wide variety of sizes and forms for a wide variety of chance-selection decision-making games and other activities.

This invention accomplishes the above and other objectives with a container having a receiver tube in communication with an internal periphery of the container. The container is sized and shaped to contain a desired plurality of solid objects of equal dimension and density. Each solid object has a separate number or symbol placed visibly on its surface. The receiver tube is sized and shaped to receive a desired number of the solid objects from the container linearly within the receiver tube. Selection of numbers by chance is accomplished by: (1) shaking the container with the receiver tube in a relatively upright attitude to mix the solid objects randomly in the container while preventing entry of the solid objects into the receiver tube, (2) positioning the container with the receiver tube in a relatively downward angle from the container such that a certain number of the solid objects, predetermined by length of the receiver tube, fall one-by-one into the receiver tube where they are contained linearly, and (3) reading the numbers or symbols on the solid objects through a transparent wall of the receiver tube. A writing instrument, such as a pen, can be positioned on a distal end opposite a proximal end of the receiver tube to which the container is attached to form a writing instrument with which chance selections can be recorded conveniently when read.

Other objects, advantages and capabilities of the invention will become apparent from the following description taken in conjunction with the accompanying drawings showing preferred embodiments of the invention.

DESCRIPTION OF THE PREFERRED EMBODIMENTS

Figures 1, 2, 3, 4, 5, 6, 7, 8, 9, 10, 11, 12:
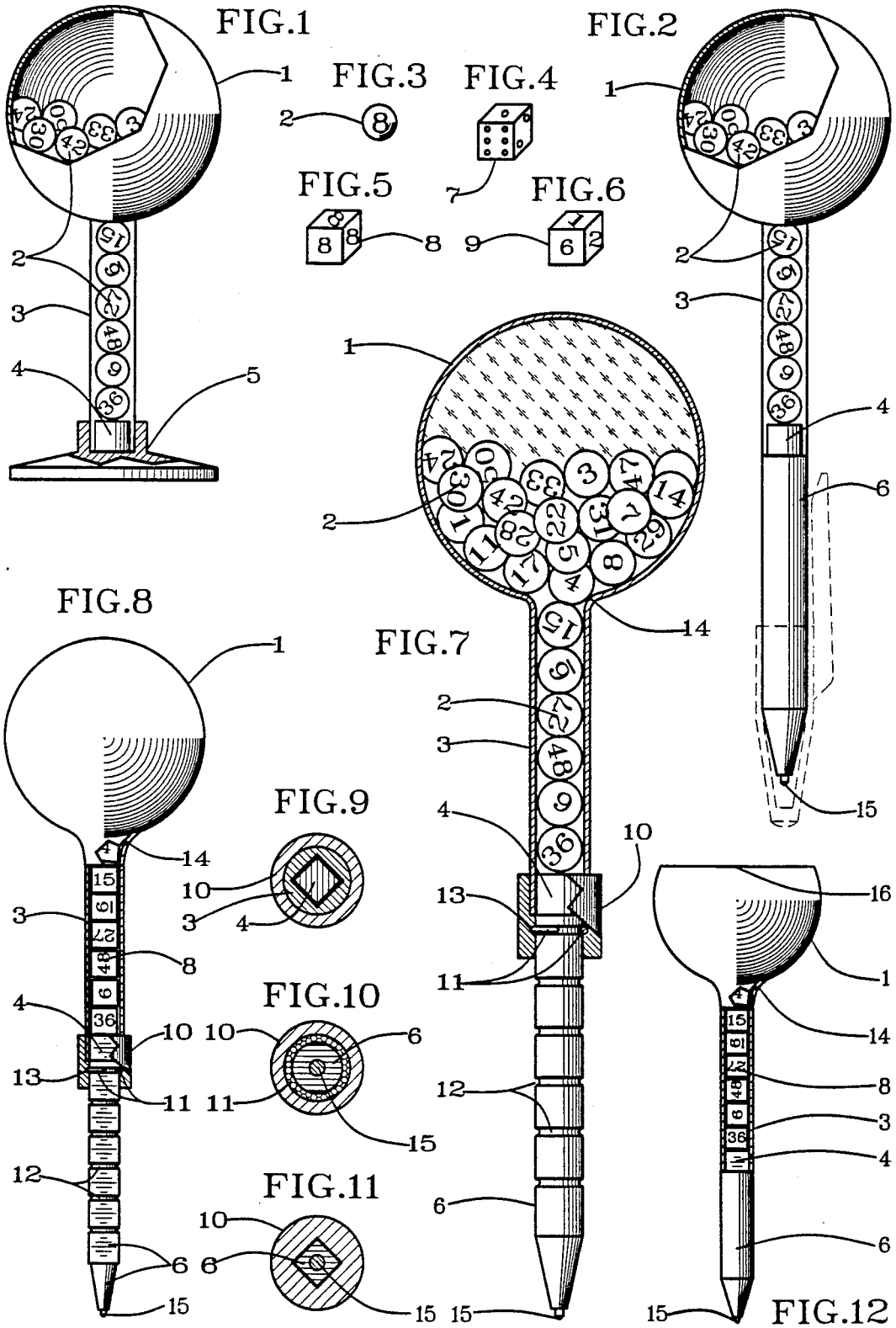
FIG. 1 is a cutaway elevation view of an embodiment having an optional stand.
FIG. 2 is a partial cutaway elevation view of an embodiment with a writing instrument as an exit restriction.
FIG. 3 is an optionally spherical numbered solid object to be used with this invention.
FIG. 4 is a dice as an optional solid object to be used with this invention.
FIG. 5 is a cube with the same number on all sides as an optional solid object for this invention.
FIG. 6 is a cube having a different number on each side as still another optional solid object to be used with this invention.
FIG. 7 is a partial cutaway elevation view of an embodiment having a transparent container and a writing instrument with which the number of spherical objects contained in a receiver tube is variable.
FIG. 8 is a partial cutaway elevation view of an embodiment having a square receiver tube and cubical solid objects receivable in it from a container.
FIG. 9 is a cross section of the FIG. 8 illustration at a top portion of a control sleeve.
FIG. 10 is a cross section of the FIG. 8 illustration at a control-ring portion of a control sleeve.
FIG. 11 is a cross section of the FIG. 8 illustration at a control-sleeve portion of a control sleeve.
FIG. 12 is a partial cutaway elevation view of an embodiment having a flat surface on the container as a stand and having a writing instrument in conjunction with a receiver tube.

Referring to the drawings wherein like reference numerals designate corresponding parts throughout the several figures, reference is made first to FIG. 1. A container 1 has an inside periphery into which a desired plurality of spherical solid objects 2 are contained. Each of the spherical solid objects 2 has a separate number inscribed on it. A receiver tube 3 having a hollow inside periphery is extended at a proximal end from the container 1 with the hollow interior of the receiver tube 3 in communication with the inside periphery of the container 1. The receiver tube 3 has a length which can contain a desired number of the spherical solid objects 2 linearly within it. An exit restriction 4 in a distal end of the receiver tube 3 prevents the solid objects 2 which enter the receiver tube 3 from escaping. The receiver tube 3 can be placed in a stand 5 to hold it with the spherical solid objects 2 in view through transparent walls of the receiver tube 3. The container 1 may be transparent, variously translucent or opaque. The receiver tube 3, however, must be transparent to allow detection of numbers on solid objects inside of it.

Referring to FIG. 2, a writing instrument 6 such as a ballpoint pen can be attached to the exit restriction 4 for convenience. In this embodiment, a writing instrument 6 is an integral part of this lottery number selector.

FIGS. 3–6 depict different types of solid objects on which symbols, numbers or a combination of numbers and other types of symbols can be inscribed for use with this invention. FIG. 3 is a spherical solid object 2 on which at least one of the same number or other symbol can be inscribed. FIG. 4 is a dice 7 as a cubical solid object on which symbols indicating numbers are inscribed as an option for particular embodiments of this invention. FIG. 5 is a single-numbered cubical solid object 8 which can be used as an option to spherical solid objects 2 because it contains only one number. FIG. 6 is a multiple-numbered cubical solid object 9 which can be used for different types of games and chance decision-making with this invention.

With this variety of types of solid objects, a large number of games of chance and chance decision-making are possible. Additionally, with variations in length or vacant length of the receiver tube 3 and with foreseeable variations of symbol and number combinations inscribed on them, most games of chance can be duplicated in principle. Additional games can be devised also. This is a highly versatile and convenient selector of combinations of numbers and/or symbols randomly by chance.

Referring to FIG. 7, a writing instrument 6 can be attachable in working relationship to an exit restriction 4 that is in sliding contact with the inside periphery of the receiver tube 3 in order to regulate vacant length of the receiver tube 3. To make the vacant length of the receiver tube variable in increments equal to width of spherical solid objects 2 or other solid objects such as 7, 8 or 9 that can be positioned in various forms of container 1, a control sleeve 10 can be used in working relationship to a control ring 11 and control grooves 12 in a control shaft such as a writing instrument 6.

A tube end of the control sleeve 10 is attachable rigidly to the distal end of the receiver tube 3. The writing instrument 6 or other control shaft is in slidable contact with an inside periphery of a shaft end of the control sleeve 10. The control grooves 12 are circumferential and positioned at increments equal to width of the solid objects 2, 7, 8 or 9. The control rings 11 are based in sleeve grooves 13 that are positioned circumferentially in the inside periphery of the shaft end of the control sleeve 10. Typically, the control rings 11 are resilient O-rings that can be made of rubber-like material or coil springs. Rubber O-rings or coil springs are preferable to other types of rings because the inside periphery of either provides a double-bevelled edge with a curved surface in either direction of linear travel of the control-shaft writing instrument 6. A major portion of the O-ring type of control ring 11 is embedded in the sleeve groove 13 to hold it in place. Then when the writing instrument 6 is pushed inward or pulled outward to reposition the exit restriction 4, the O-ring 11 is compressed into the sleeve groove 13 by contact with slanted or arcuate walls of the control grooves 12 by linear travel of the writing instrument 6. Between control grooves 12, the control ring 11 is compressed tightly against outside walls of the writing instrument 6. The control ring 11 seats in each control groove 12 to retain the writing instrument 6 in an incremental position unless moved with a force requiring awareness of a user.

A tube entrance 14 at a proximal end of the receiver tube can be rounded as necessary to assure ease of passage of the solid objects 2, 7, 8 or 9 from the container 1 into the inside periphery of the receiver tube 3. For cubical solid objects such as 7, 8 or 9, the tube entrance 14 is more tapered and longer than for spherical solid objects 2.

The container 1 in FIG. 7 is depicted as transparent. The spherical solid objects 2 are shown half-filling the container 1 and a predetermined number positioned linearly in the inside periphery of the receiver tube after having fallen one-at-a-time into the receiver tube 3.

Referring to FIG. 8, cubical solid objects 8 can be placed in the container 1 as an alternative to spherical solid objects 2 described in relation to FIGS. 1, 2 and 7. For using solid objects with cubical forms, it is preferable that the tube entrance 14 have a longer taper to start the cubical solid objects 8 downward in a funneling action. The inside periphery of the receiver tube can be cylindrically round or square but is preferably square.

For playing conventional state lotteries with the use of cubical solid objects 8, the same number should be inscribed on all six sides unless the inside of the receiver tube 3 is square and only one-fourth of a linear circumference of the receiver tube 3 is transparent. One-sixth as many multiple-numbered cubical solid objects 9 as spherical solid objects 2 or single-numbered cubical solid objects 8 can be used with a receiver tube 3 having an inside periphery that is square and that is transparent on only one-fourth of a circumference linearly along one flat surface of the square inside periphery of the receiver tube 3. Fewer solid objects 9 allows use of a much smaller container 1 that is more convenient to carry. It isn't as big a bulge in one's pocket or purse. Also, either cubical solid object 8 or 9 can be smaller than spherical solid objects 2 because the numbers are positioned to be read easier on a flat surface. Further yet, the numbers are easier to inscribe and, therefore, less expensive to produce using cubical solid objects 8 or 9.

Reference is made now to FIGS. 7–11 in relation to control of vacant length of the receiver tube 3 with the control sleeve 10 and its control ring 11 which is based in sleeve groove 13 and fits into control grooves 12 at increments of travel of the writing instrument 6. This working relationship is easier to depict for spherical inside diameters of the receiver tube 2, the control sleeve 10 and the writing instrument 6 that are round at a cross section in FIG. 7 than it is to illustrate a round control ring 11 in working relationship to corresponding inside surfaces that are square at cross sections in FIG. 8. For this reason, cross-sectional drawings of this control mechanism for the same components in square shape are shown in FIGS. 9–11.

FIG. 9 represents a cross section at the distal end of the receiver tube 3 where the control sleeve 10 fits rigidly onto an outside periphery of the receiver tube 3 in FIG. 8. FIG. 10 represents a cross section at the control groove 13 which contains the control ring 11. FIG. 11 represents a cross section where the outside periphery of the writing instrument 6 is in sliding contact with the inside periphery of the control sleeve 10.

The outside periphery of the exit restriction 4 and the inside periphery of the receiver tube 3 are both square at the rigidly joining section of the control sleeve 10 and the receiver tube 3 as shown in FIG. 9. Likewise, the inside periphery of the control sleeve 10 and the outside periphery of the writing instrument 6 are both square at the section of their sliding contact as shown in FIG. 11. The section requiring special attention to visualize is at the control ring 11. There the control groove 12 is round at each incremental position while the shaft 6 and inside periphery of the control sleeve 10 are square as shown. The roundness is compensated by graduated deeper depths of the control groove 12 circumferentially at corners than at flat surfaces of the writing instrument 6 in square form. Bottoms of the sleeve groove 13 and of the control grooves 12 can be round. The control ring 11 can fit into the bottom of the sleeve groove 13 but need not be thick enough to contact bottoms of control grooves 12. Resistance to travel of the shaft 6 by the control ring 11, therefore, will be greater at corners than at flat surfaces of square shafts 6.

The control sleeve 10 is shown to have a round or cylindrical outside surface. This is not necessary. The outside periphery of control sleeve 10 can be any desired shape although a cylindrical surface is preferable.

A ballpoint shaft 15 or other writing medium for a writing instrument 6 is a necessary component of embodiments which employ a writing instrument. It is a use component instead of an adjustment component.

Referring to FIG. 12, the container 1 can have a flat surface 16 to function as a stand when not in use and in an upside down attitude. This is a particularly convenient feature for applications in which this lottery number selector may be left for use intermittently by different individuals or by the same individual. Most vendors of lottery tickets, for example, may find several of them convenient for customers. Vendors may choose to chain them down to prevent their being stolen, however, because of their extremely high popularity potential. A user may want this embodiment handy on a table or office desk where it will be used. Due to its high desirability and advantages, advertisers or business establishments may find either embodiment profitable to distribute free with their desired identity inscribed on it.

In addition to being used in relationship to playing lottery, various forms of this invention are desirable for a wide variety of games. It can be made to replace dice, cards, roulette wheels, some types of slot machines and other game devices. Also, it can be used as a supplement to other games of chance in a similar manner to its use for playing lottery.

Only a few basic combinations and forms of this lottery number selector are shown for brevity. A wider variety are foreseeable and anticipated within this invention. For instance, either a transparent or a non-transparent container 1 can be used with either type of receiver tube 3 and, further, with either type of writing instrument 2 or stand 5. Further in addition, the flat-sided container 16 can be used in conjunction with either combination of other components. Further yet, different shapes of solid objects 2, 7, 8 and 9 can be used with any combination of the other components. Still further, variations of each component not described but nevertheless apparent hereafter to those skilled in the art are foreseeable and anticipated also.

Various modifications may be made of the invention without departing from the scope thereof and it is desired, therefore, that only such limitations shall be placed thereon as are imposed by the prior art and which are set forth in the appended claims.

What is claimed is:

1. A lottery number selector comprising:

a container having an internal periphery sized and shaped to contain a desired plurality of solid objects, the container having an exit aperture therein sized to dispense the solid objects therethrough, a desired plurality of solid objects having substantially equal dimensions and density contained in the container, at least one symbol inscribed visibly on an outside surface of each of the solid objects positioned in the container, a receiver tube with an inside periphery having a tube entrance at a proximal end in communication with the exit aperture in the inside periphery of the container, a size and shape of the tube entrance designed for fall of solid objects one-at-a-time from the container into the receiver tube with the receiver tube positioned in a downward attitude in relation to the container, a distal end of the receiver tube with an exit restriction designed to prevent exit of any solid objects received in the receiver tube from the container, a size and shape of the inside periphery of the receiver tube to receive a predetermined number of the solid objects linearly from the container, a wall of the receiver tube that is sufficiently transparent for visual detection of the symbol on the outside surface of each solid object that enters the receiver tube from the container, a control sleeve attachable rigidly to an outside periphery of the distal end of the receiver tube and having a ring section of the control sleeve extended a desired distance beyond the distal end of the receiver tube, an inside periphery of the ring section of the control sleeve sized and shaped to receive a control shaft, a control shaft attachable to the exit restriction and sized and shaped to fit in sliding contact with the inside periphery of the control sleeve and with the inside periphery of the receiver tube, a sleeve ring groove in the inside periphery of the control sleeve, a plurality of shaft ring grooves in the outside periphery of the control shaft separated at increments that are equal to a width of the solid objects, and a control ring having an outside periphery attachable to the sleeve ring groove and having a double-wedged inside periphery engageable with the shaft ring grooves.

2. A lottery number selector as claimed in claim 1, wherein the control shaft is a shaft of a writing instrument.

3. A lottery number selector as claimed in claim 2, wherein the control ring is a resilient O-ring.

* * * * *